US009036849B2

(12) United States Patent
Thompson et al.

(10) Patent No.: US 9,036,849 B2
(45) Date of Patent: May 19, 2015

(54) HEADSET WITH STOWABLE BOOM

(75) Inventors: Dale E Thompson, Cupertino, CA (US); Manoj Mistry, Santa Cruz, CA (US); John B Ledingham, Scotts Valley, CA (US); Matthew E Kramer, Los Gatos, CA (US)

(73) Assignee: Plantronics, Inc., Santa Cruz, CA (US)

( * ) Notice: Subject to any disclaimer, the term of this patent is extended or adjusted under 35 U.S.C. 154(b) by 1414 days.

(21) Appl. No.: 12/190,546

(22) Filed: Aug. 12, 2008

(65) Prior Publication Data

US 2010/0040252 A1 Feb. 18, 2010

(51) Int. Cl.

| | |
|---|---|
| ***H04R 25/00*** | (2006.01) |
| ***H04R 1/08*** | (2006.01) |
| *H04R 1/10* | (2006.01) |
| *H04R 5/033* | (2006.01) |

(52) U.S. Cl.

CPC ..... *H04R 1/083* (2013.01); *H04R 1/1008* (2013.01); *H04R 1/1066* (2013.01); *H04R 5/0335* (2013.01)

(58) Field of Classification Search

None

See application file for complete search history.

(56) References Cited

U.S. PATENT DOCUMENTS

| | | | | | |
|---|---|---|---|---|---|
| 4,875,233 | A | * | 10/1989 | Derhaag et al. | 379/430 |
| 5,721,775 | A | | 2/1998 | Leifer | |
| 5,978,689 | A | | 11/1999 | Tuoriniemi et al. | |
| 6,016,347 | A | * | 1/2000 | Magnasco et al. | 379/430 |
| 6,118,878 | A | * | 9/2000 | Jones | 381/72 |
| 6,373,942 | B1 | * | 4/2002 | Braund | 379/430 |
| D514,086 | S | * | 1/2006 | Skulley | D14/206 |
| D517,528 | S | * | 3/2006 | Skulley | D14/206 |
| 7,120,267 | B2 | | 10/2006 | Ito et al. | |
| D535,285 | S | * | 1/2007 | Skulley | D14/205 |
| D540,778 | S | * | 4/2007 | Thompson et al. | D14/206 |
| D541,256 | S | * | 4/2007 | Rausch et al. | D14/205 |
| 2004/0252487 | A1 | * | 12/2004 | McCullough et al. | 362/105 |
| 2005/0226452 | A1 | * | 10/2005 | Amae et al. | 381/381 |
| 2007/0036386 | A1 | * | 2/2007 | Amae | 381/388 |
| 2010/0040245 | A1 | * | 2/2010 | Buil et al. | 381/107 |
| 2010/0040252 | A1 | * | 2/2010 | Thompson et al. | 381/375 |
| 2011/0044463 | A1 | * | 2/2011 | DiRusso | 381/71.6 |
| 2013/0028460 | A1 | * | 1/2013 | Lee et al. | 381/370 |
| 2013/0121524 | A1 | * | 5/2013 | Liao | 381/375 |

FOREIGN PATENT DOCUMENTS

| | | | | | |
|---|---|---|---|---|---|
| CA | 2322283 | | * | 3/1988 | |
| CA | 2322283 | C | * | 8/2005 | |
| EP | 1530348 | A1 | * | 5/2005 | H04M 1/05 |
| WO | WO 9903294 | A2 | * | 1/1999 | H04Q 7/38 |
| WO | 01/86923 | A1 | | 11/2001 | |

OTHER PUBLICATIONS

New SADES Gaming Headset Microphone Stereo, Dec. 8, 2014.*

571639, Jan. 1999, DW.*

* cited by examiner

*Primary Examiner* — Marlon Fletcher

(57) ABSTRACT

A headset comprises a headband for supporting the headset on a user's head, an earpiece including an audio driver and a microphone boom including a microphone. The microphone boom is rotatable when the headset is located on a user's head from an operative position in which the microphone boom is directed towards the user's mouth to a stowed position in which the microphone boom is at least partially received in a recess defined in the headset.

17 Claims, 8 Drawing Sheets

HEADSET WITH STOWABLE BOOM

FIELD OF THE INVENTION

The present invention relates to headsets. More specifically the invention relates to microphone booms utilized with headsets.

BACKGROUND OF THE INVENTION

Today PC users are able to use a multifunctional headset that can be used for listening to music, gaming and Internet based telephone calls. These jack-of-all-trades headsets usually come with a microphone boom to enable the headset to be used as a communication device in addition to audio playback. It is also commonly known that headset users prefer that the microphone boom be designed so that it can be moved away from their mouth when the headset user is eating or drinking or when the microphone boom is in non-use, such as when listening to music or playing solitary games. Headsets in the past have addressed this problem by having a rotatable microphone boom.

Another desire of PC headset users, especially among children and young adults, is to have a headset that is trendy and fashionable. It is believed that headset users feel that a microphone boom makes the headset user appear to be dorky or nerdy even when the microphone boom is rotated away from the headset user's face.

SUMMARY OF THE INVENTION

According to one aspect of the invention, a headset comprises a headband for supporting the headphone on a user's head, an earpiece including an audio driver and a microphone boom including a microphone. The microphone boom is rotatable when the headphone is located on a user's head from an operative position in which the microphone boom is directed towards the user's mouth to a stowed position in which the microphone boom is at least partially received in a recess defined in the headphone. In one embodiment the recess is defined in the headband and a visible surface of the microphone boom generally conforms to an outer surface of the headband when in the stowed position. The microphone boom may be rotatable about an axis that is generally parallel to a line stretching between a user's ears.

The microphone boom may include a strip of material that is flexible in a first direction but substantially rigid in a second direction, and the headband may include a retaining mechanism for the microphone boom comprising, for example, protrusions on a surface defining the recess or comprising cooperating angled surfaces on the microphone boom and on the headband.

In another embodiment, the recess is defined in the earpiece and a visible surface of the microphone boom conforms to an outer surface of the earpiece when the microphone boom is in the stowed position. As before, the microphone boom may be rotatable about an axis that is generally parallel to a line stretching between a user's ears. Further, the earpiece may include a retaining mechanism for the microphone boom, for example, protrusions on a surface defining the recess or cooperating angled surfaces on the microphone boom and on the earpiece. The microphone boom may further include a strip of material that is flexible in a first direction but substantially rigid in a second direction.

DETAILED DESCRIPTION OF THE DRAWINGS

The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention.

Figure 1:
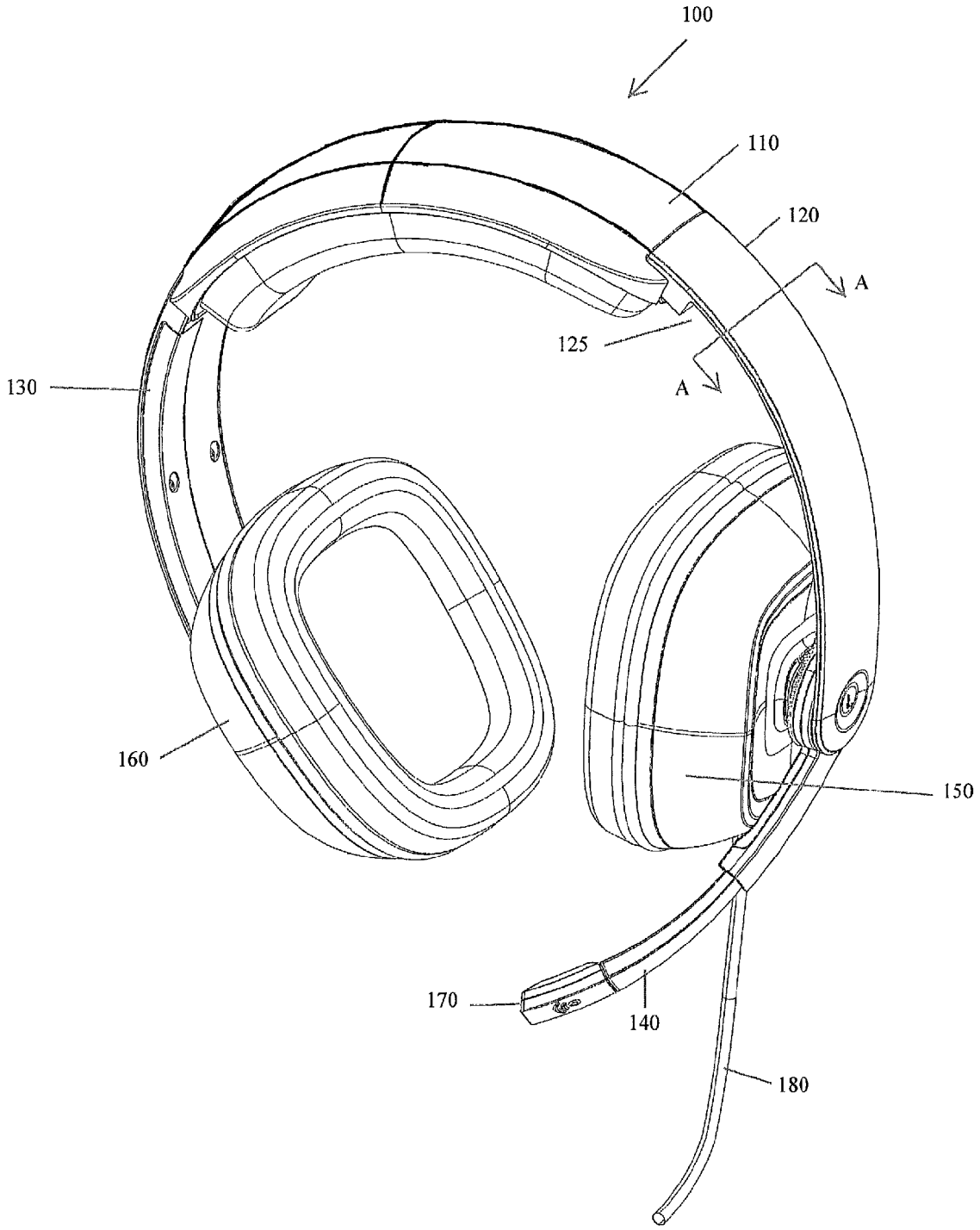
FIG. 1 is a perspective view of a headset according to one embodiment of the invention.

Referring to FIG. 1, shown is a headset 100 according to one embodiment of the invention. The headset 100 comprises a right earpiece 160, a headband (including a right speaker arm 130, a central support 110 and a left speaker arm 120), a left earpiece 150, a microphone boom 140 and a cord 180.

The right earpiece 160 is conventional in nature and fits over a user's right ear. The right earpiece 160 includes an audio driver (not shown in FIG. 1) to convert an audio signal, received via cord 180, to an audible output. The right earpiece 160 is pivotably coupled to the right speaker arm 130 to provide a comfortable fit against the user's head. The right earpiece 160 is virtually identical to the left earpiece 150, which is shown in more detail in FIG. 3.

The right speaker arm 130 is pivotably coupled to the right earpiece 160 at its one end to hold the right earpiece 160 in place on the user's head. The opposite end of the right speaker arm 130 is slidably coupled to one end of the central support 110. The slidable coupling permits the right speaker arm 130 to slide into and out of the central support 110 so that the user can adjust the size of the headset 100.

The central support 110, which adds comfort and support to the headset 100, is slidably coupled at one end to the right speaker arm 130 and slidably coupled to the left speaker arm 120 on its opposite end.

As with the right speaker arm 130, the left speaker arm 120 is slidably coupled at one end to the central support 110 and pivotably coupled to the left earpiece 150 and to the microphone boom 140 at its opposite end. The left speaker arm 130 is shown in more detail in FIG. 3. A recess 125 is defined by the left speaker arm 120 such that the microphone boom 140 is stowable in the recess 125 and such that the exposed surface of the microphone boom 140 generally conforms to an outer profile of the left speaker arm 120 when in the stowed position.

As with the right earpiece 160, the left earpiece 150 is pivotably coupled to the left speaker arm 120. The left earpiece 150 is shown in more detail in FIG. 3.

The microphone boom 140 includes a noise-cancelling microphone (not shown) in its tip 170. The microphone is used to convert the user's voice to an electrical signal, which is then relayed to an appropriate electronic device via the cord 180. The microphone boom 140 can be adjusted by the user in a number of ways—it is telescoping (i.e. its length can be adjusted), it can be moved up and down via the pivotable connection with the left speaker arm 120, and it is plastically bendable towards and away from the user's mouth.

The microphone boom 140 is pivotable, about an axis generally parallel to a line stretching between the user's ears, from an operative position (shown in FIG. 1) in which the microphone boom 140 is directed towards the user's mouth, to a stowed position (shown in FIG. 2) in which the microphone boom 140 is at least partially received in the recess 125. The microphone boom 140 is shown in more detail in FIG. 6.

Figure 2:
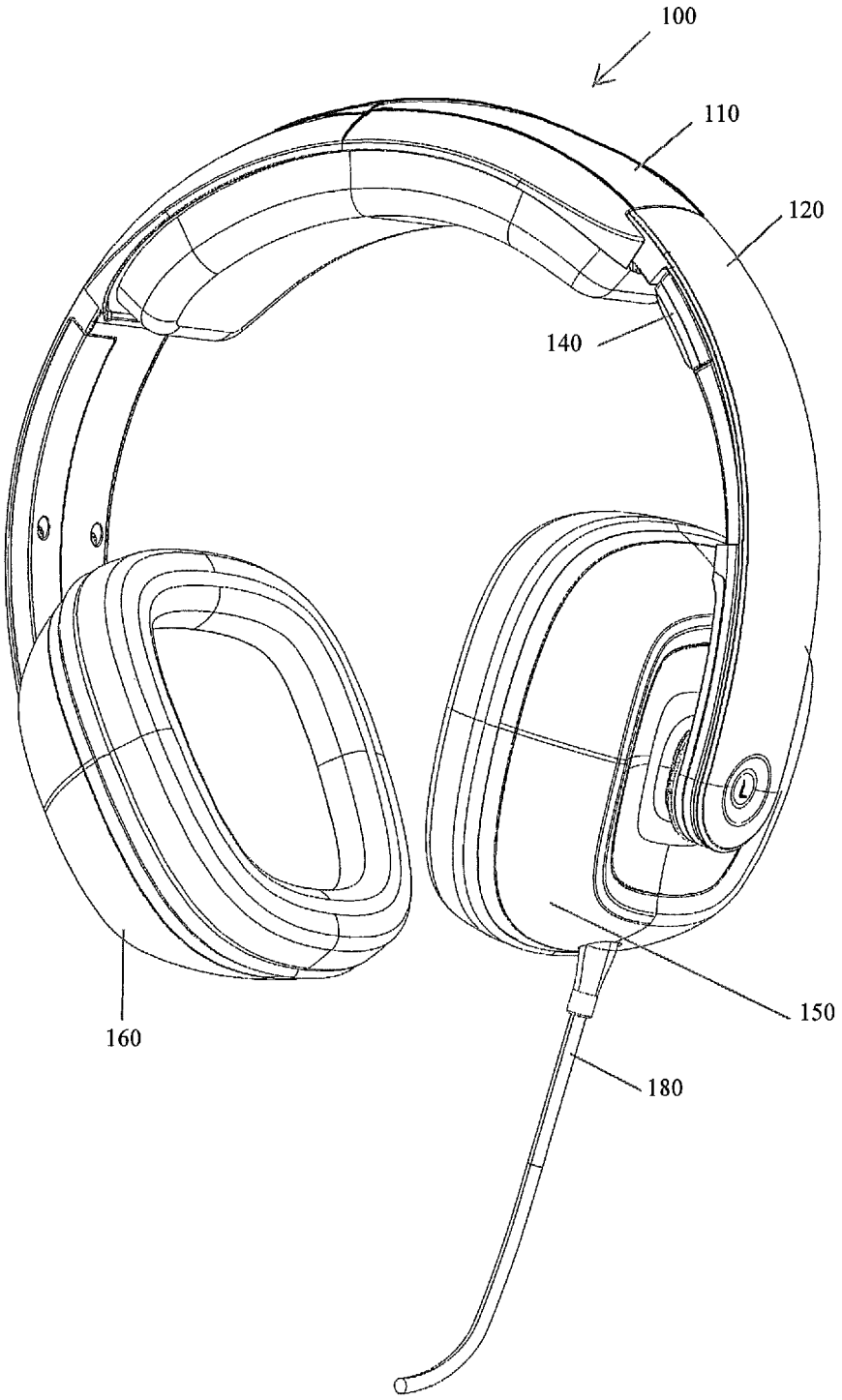
FIG. 2 is a perspective view of the headset of FIG. 1 with the microphone boom in the stowed position.

Referring to FIG. 2, shown is the headset 100 in which the microphone boom 140 is in the stowed position in the recess 125 defined by the left speaker arm 120. As can be seen from this figure, when in the stowed position the microphone boom 140 generally conforms to an outer profile of the left speaker arm 120, thereby to give the headset 100 the appearance of a conventional headphone that does not include a microphone boom. It is believed that concealing the microphone boom 140 in this way provides a more aesthetically-pleasing appearance when the use of a microphone is not required.

Figure 3:
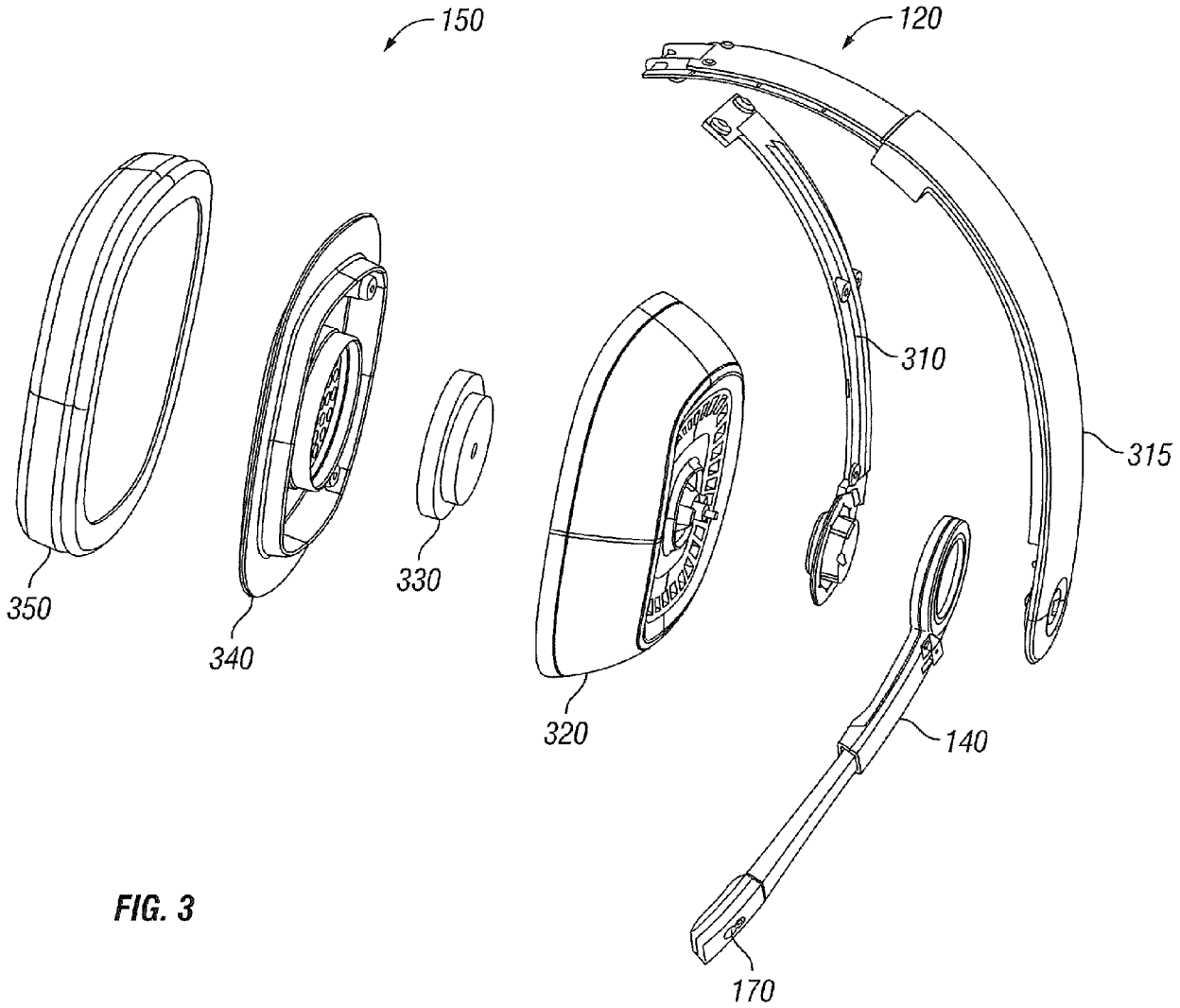
FIG. 3 is an exploded view of the left earpiece and the left speaker arm of the headset of FIG. 1.

Referring to FIG. 3, shown is an exploded view of the left earpiece 150 and the left speaker arm 120. The left earpiece 150 comprises a cushion 350, a grille 340, an audio driver 330, and a speaker housing 320. The left speaker arm 120 includes a speaker arm backing 310 and a speaker arm cover 315. The microphone boom 140 is pivotably coupled between the speaker arm backing 310 and speaker arm cover 315 such that it may be positioned to and from the stowed position and operative position.

Figure 4:
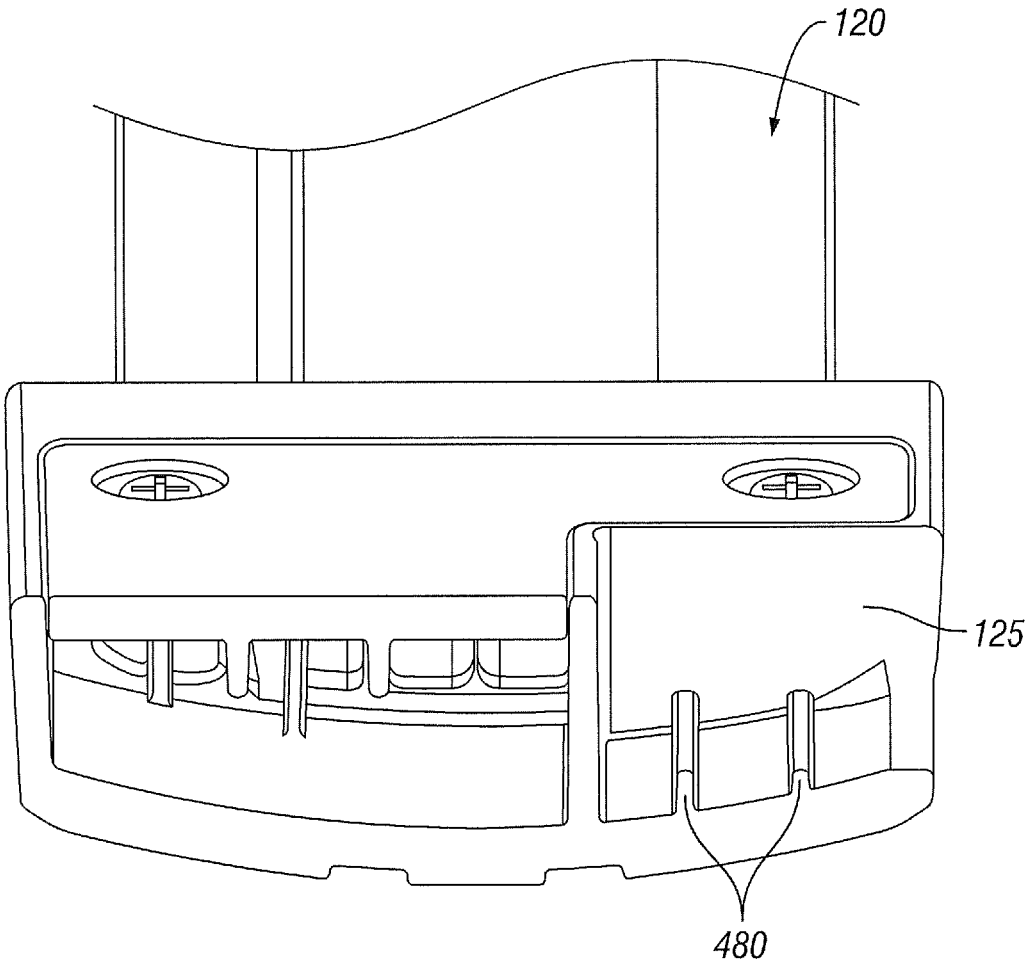
FIG. 4 is a cross sectional view of the left speaker arm of the headset of FIG. 1 at section A-A.

The headset 100 includes two features that function as retaining mechanisms to hold the microphone boom 140 in the recess 125. Referring firstly to FIG. 4, shown is a cross section at section A-A of FIG. 1 of the left speaker arm 120 and the recess 125 defined by the left speaker arm 120 at the point where the microphone tip 170 enters the recess 125 defined by the left speaker arm 120. This upper part of the recess 125 defined by the left speaker arm 120 includes ribs 480 that engage the microphone tip 170 to assist in retaining the microphone boom 140 in the stowed position.

Figure 5:
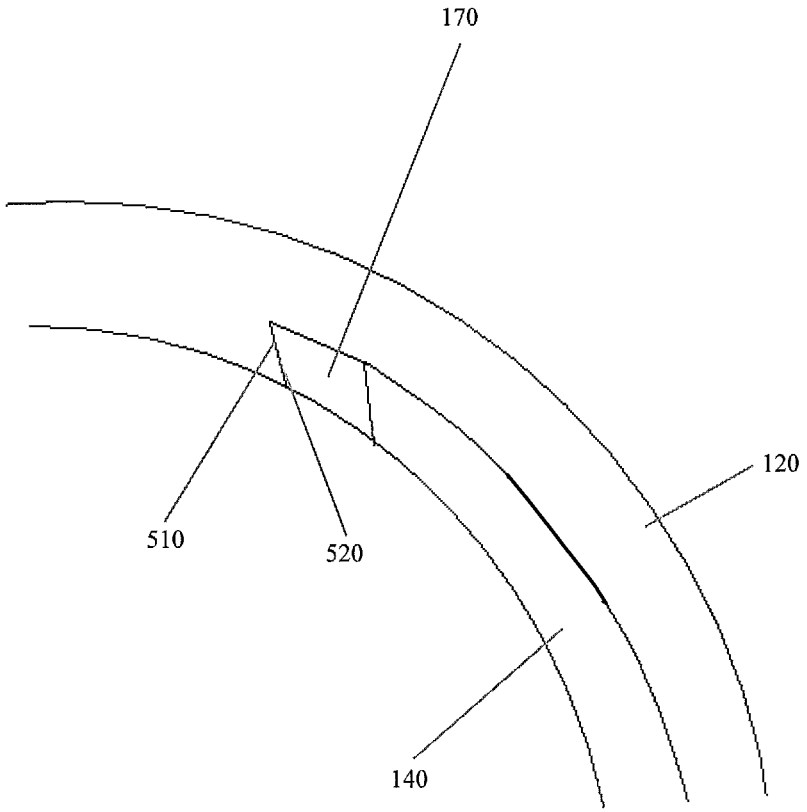
FIG. 5 is a close up front view of the microphone boom and the microphone tip in the stowed position.

Referring secondly to FIG. 5, shown is a close up view of the microphone boom 140 and the microphone tip 170 in the stowed position looking towards the front of the headset 100. As can be seen from the figure, a surface 510 that defines the end of the recess 125 and a surface 520 at the end of the microphone boom 140 are angled to interact to and prevent the microphone tip 170 from protruding out of the recess towards the user's head. In this regard, the length of the recess 125 and the shortest length of the telescoping microphone boom 140 are chosen such that the surfaces 510 and 520 interact as illustrated.

Figure 6:
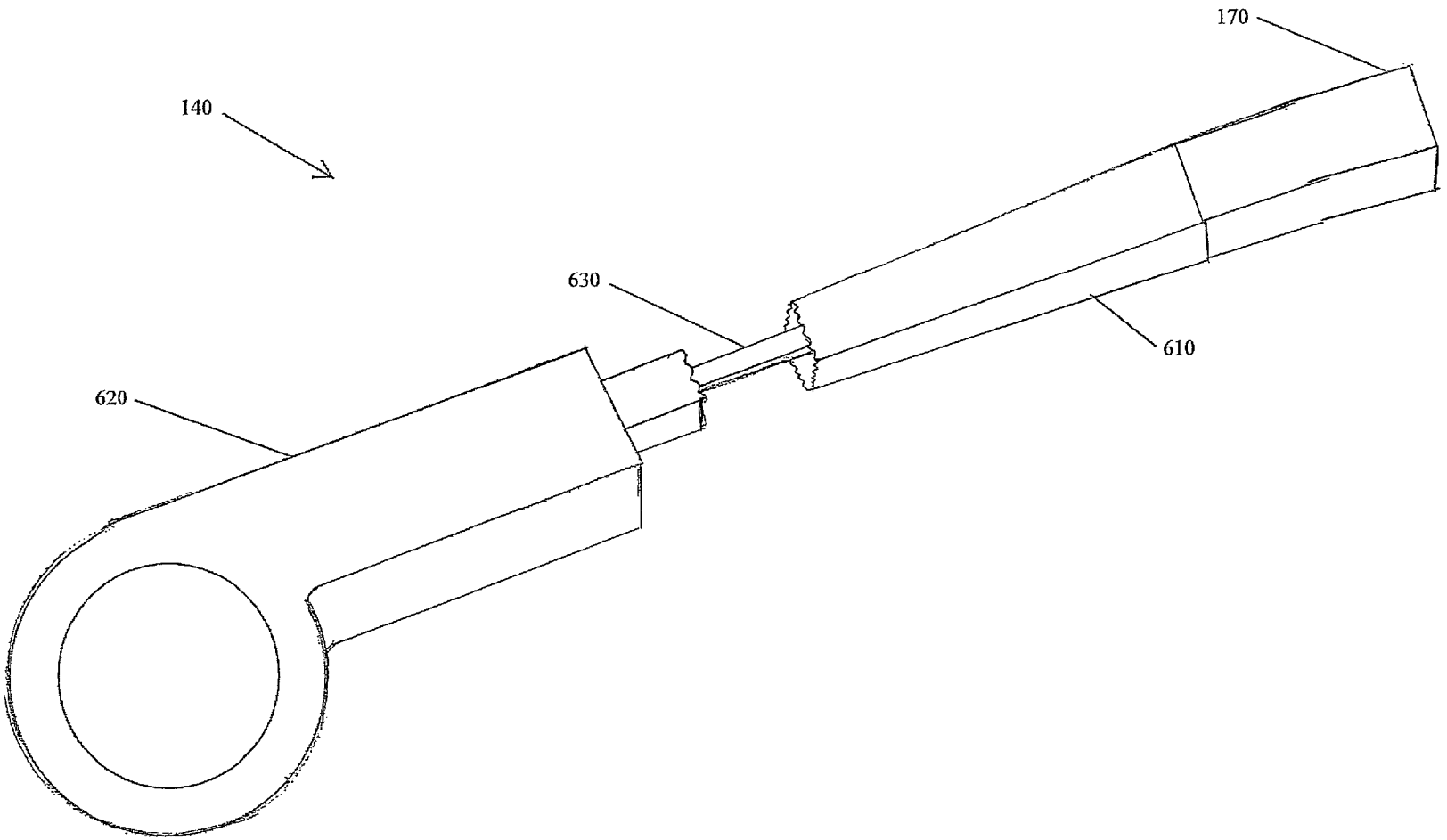
FIG. 6 is an enlarged perspective view of the microphone boom.

Referring to FIG. 6, shown is an enlarged perspective view of the microphone boom 140. The microphone boom 140 includes a pivot arm 620, a telescoping stalk 610, and a microphone tip 170. The telescoping stalk 610 may be extended from or retracted into the pivot arm 620 to allow the microphone tip 170 to be positioned adjacent to a user's mouth. The telescoping stalk 610 is preferably made of a plastic, or another suitable flexible and lightweight material. The telescoping stalk 610 is arranged to be flexible towards and away from the user's mouth but relatively rigid when pivoting into and out of the stowed position. This is accomplished in part by including a metal strip 630 orientated within the telescoping stalk 610 such that the microphone boom 140 is fairly flexible in the directions towards and away from the wearer's mouth and fairly rigid in the direction of rotation of the boom. In this embodiment, the metal strip 630 is made of copper, which tends to retain its shape when bent, but of course any other suitable material may be used.

Figure 7:
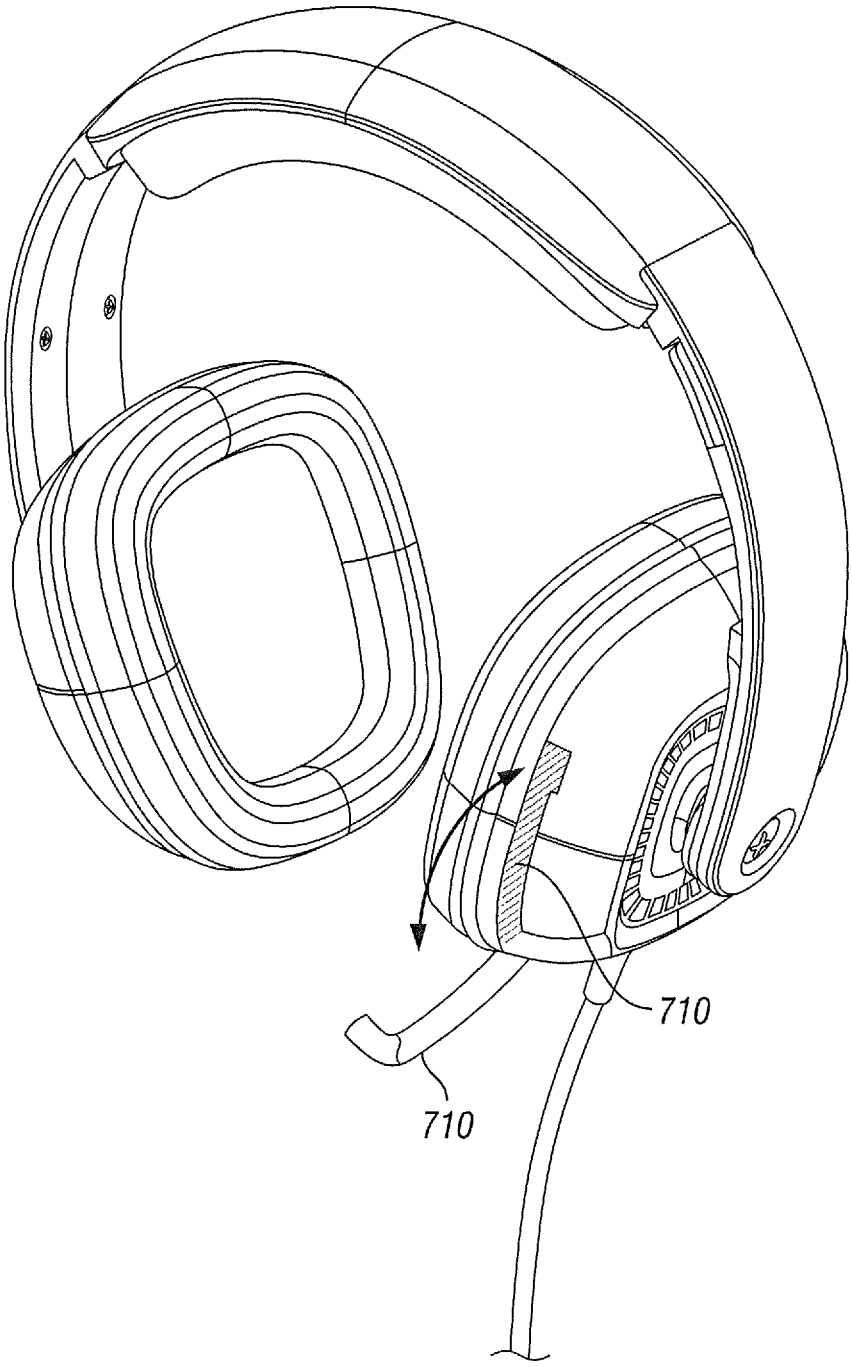
FIG. 7 is a perspective view of an alternate embodiment of a headset according to the invention.

Referring to FIG. 7, shown is an alternative embodiment in which the microphone boom 700 is coupled to the left earpiece 150 and is stowable in a recess 710 defined by the left earpiece 150. In this embodiment, when the microphone boom 700 is in the stowed position the exposed surface of the microphone boom 700 generally conforms to an outer profile of the left earpiece 150, again giving the appearance of a conventional microphone-free headphone when the microphone boom 700 is stowed. Other than the location of the microphone boom 700, this alternative embodiment includes the features found in the first embodiment with appropriate and/or necessary modifications.

Figure 8:
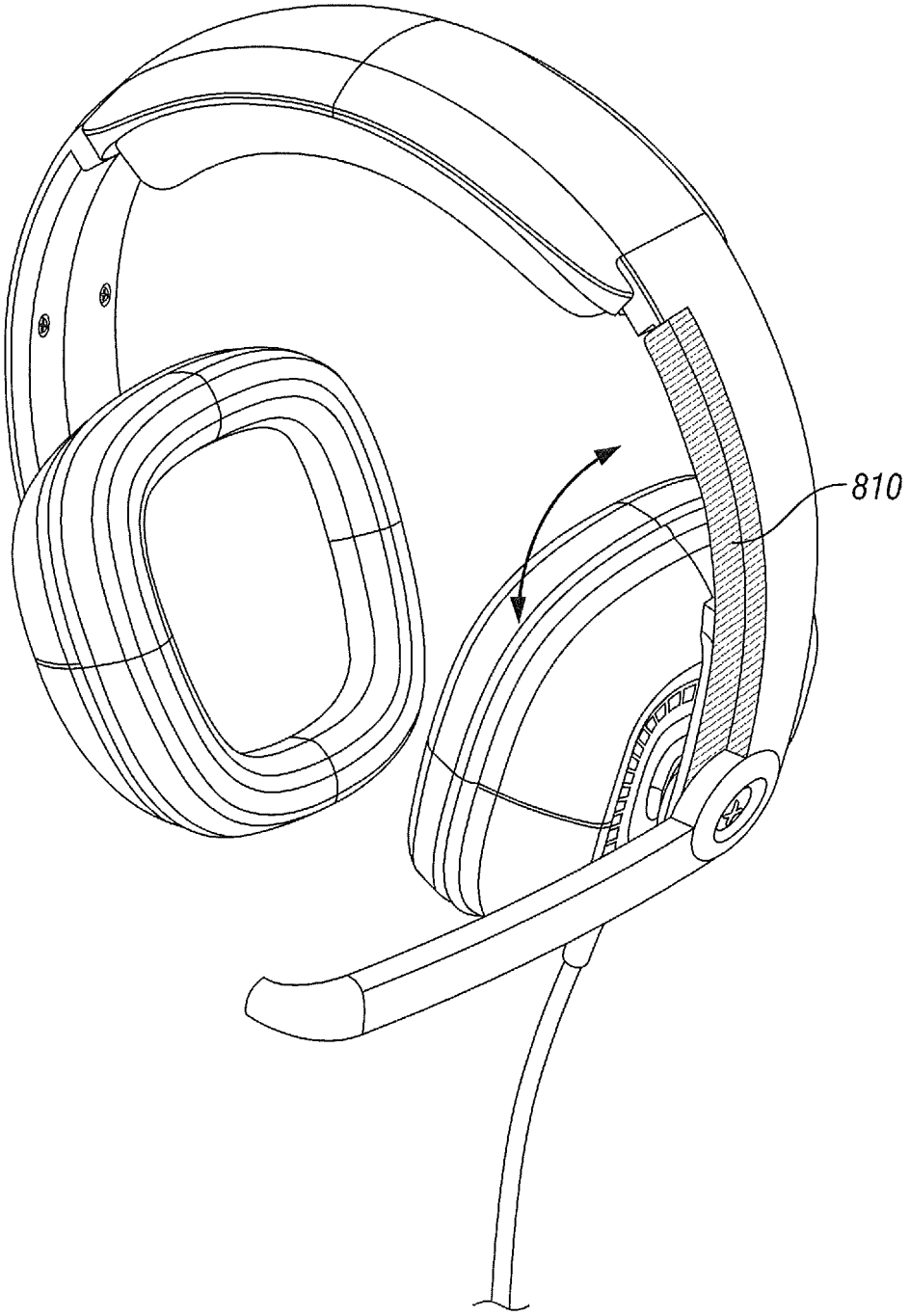
FIG. 8 is an illustration of a second alternate embodiment of a headset according to the invention.

Referring to FIG. 8, shown is another alternative embodiment in which the microphone boom 140 is coupled to the left speaker arm cover 315 and is stowable in a recess 810 located on the obverse surface of the left speaker arm 120. Other than the location of the microphone boom 140, this alternative embodiment includes the features found in the first embodiment with appropriate and/or necessary modifications.

Although the present invention has been described with reference to specific embodiments thereof, these embodiments are merely illustrative, and not restrictive of, the present invention. Various modifications or changes to the specifically disclosed exemplary embodiments will be suggested to persons skilled in the art. In summary, the scope of the invention should not be restricted to the specific exemplary embodiments disclosed herein, and all modifications that are readily suggested to those of ordinary skill in the art should be included within the spirit and scope of the invention.

What is claimed is:

1. A headset, comprising:

a headband for supporting the headset on a user's head;

an earpiece including an audio driver; and a microphone boom including a microphone, wherein the microphone boom rotates from an operative position, in which the microphone boom is directed towards the user's mouth, into a recess defined in the headset.

2. The headset of claim 1 wherein the recess is defined in the headband.

3. The headset of claim 2 wherein a visible surface of the microphone boom generally conforms to an outer surface of the headband when in the stowed position.

4. The headset of claim 3 wherein the microphone boom is rotatable about an axis that is generally parallel to a line stretching between a user's ears.

5. The headset of claim 2 wherein the microphone boom includes a strip of material that is flexible in a first direction but substantially rigid in a second direction.

6. The headset of claim 2 wherein the headband defines a retaining mechanism in the recess to retain the microphone boom in the recess.

7. The headset of claim 6 wherein the retaining mechanism comprises protrusions on a surface defining the recess.

8. The headset of claim 6 wherein the retaining mechanism comprises angled surface for cooperating with a corresponding surface on the microphone boom.

9. The headset of claim 7 wherein the retaining mechanism further comprises an angled surface for cooperating with a corresponding surface on the microphone boom.

10. The headset of claim 1 wherein the recess is defined in the earpiece.

11. The headset of claim 10 wherein a visible surface of the microphone boom conforms to an outer surface of the earpiece when in the stowed position.

12. The headset of claim 11 wherein the microphone boom is rotatable about an axis that is generally parallel to a line stretching between a user's ears.

13. The headset of claim 10 wherein the earpiece defines a retaining mechanism in the recess to retain the microphone boom in the recess.

14. The headset of claim 13 wherein the retaining mechanism comprises protrusions on a surface defining the recess.

15. The headset of claim 13 wherein the retaining mechanism comprises an angled surface for cooperating with a corresponding surface on the microphone boom.

16. The headset of claim 14 wherein the retaining mechanism further comprises an angled surface for cooperating with a corresponding surface on the microphone boom.

17. The headset of claim 10 wherein the microphone boom includes a strip of material that is flexible in a first direction but substantially rigid in a second direction.

* * * * *